United States Patent [19]

Trenzen

[11] Patent Number: 4,775,141

[45] Date of Patent: Oct. 4, 1988

[54] SHEET STACKING DEVICE WITH ADJUSTABLE GUIDE BANDS

[75] Inventor: Erwin Trenzen, Seeheim-Jugenheim, Fed. Rep. of Germany

[73] Assignee: Valmet-Strecker GmbH, Pfungstad T, Fed. Rep. of Germany

[21] Appl. No.: 3,768

[22] Filed: Jan. 16, 1987

[30] Foreign Application Priority Data

Jan. 17, 1986 [DE] Fed. Rep. of Germany ..... 3601295

[51] Int. Cl.[4] ..... B65H 29/14

[52] U.S. Cl. ..... 271/223; 271/198; 271/299; 414/35

[58] Field of Search ..... 414/35, 36, 113, 900; 271/171, 223, 224, 221, 210, 215, 217, 34; 231/198, 200, 225, 236, 299

[56] References Cited

U.S. PATENT DOCUMENTS

| | | | |
|---|---|---|---|
| 2,585,076 | 2/1952 | Bandura et al. | 271/224 |
| 3,977,671 | 8/1976 | Taylor et al. | 271/221 |
| 4,381,108 | 4/1983 | Newsome | 271/198 |
| 4,484,736 | 11/1984 | Osburg et al. | 271/220 |

FOREIGN PATENT DOCUMENTS 402158 9/1924 Fed. Rep. of Germany .

*Primary Examiner*—H. Grant Skaggs
*Attorney, Agent, or Firm*—Leydig, Voit & Mayer

[57] ABSTRACT

The present invention provides a sheet stacking device capable of being easily adjusted to accomodate sheets of different format sizes. The device presents an automatically lowerable lift table, and in the zone of the upper stack end a face-side sheet feed, a plurality of endless, driven sheet guide bands extending over the stack, and several longitudinally running lateral boundary plates. Even despite liberal adjustment of the format width, faultless guidance of the fed-in sheets may be achieved by the provision of a large number of sheet guide bands at normally equal intervals over the entire possible stack width. At least individual ones of the boundary plates are liftable out over two sets of sheet feed bands, and movable laterally independently of the bands. Bands standing in the way of boundary plates being driven laterally to their end position, are also drivable through a limited lateral interval. In this instance, the bands standing in the way of the boundary plates concerned, or their support, can be laterally conducted along as well. The adjustment procedure can be controlled in dependence on a presettable format width by microprocessor.

15 Claims, 5 Drawing Sheets

SHEET STACKING DEVICE WITH ADJUSTABLE GUIDE BANDS

FIELD OF THE INVENTION

The present invention relates generally to sheet stacking devices, and more particularly to sheet stacking devices which are automatically adjustable to accommodate sheets of different format sizes.

BACKGROUND OF THE INVENTION

A sheet stacking device is known from Osburg et al., U.S. Pat. No. 4,484,736, which consists of pairs of sheet guide bands with separator and stop plates positioned inbetween, individually raisable and lowerable boundary plates and sheet guide skids which may also be shifted transversely with respect to the sheet flow. This sheet stacking device disclosed by Osburg et al. does not allow for the dense occupation of the stack surface with sheet guide bands as desired in some applications. Typically, inflowing sheets are blown against the bands by means of an air stream from underneath such that there is a tendency, particularly in the case of relatively thin sheets, that the sheets will arch upward between the bands and no longer rest in faultless alignment with the rest of the previously stacked sheets. Osburg et al. also discloses vertical movement of the boundary plates and guide skids otherwise joined firmly with the bearing of the band pair concerned, and serves merely to remove individual ones of these plates or skids so as not to interfere with the sheets passing through.

It is an object of the present invention to provide a sheet stacking device which may easily accommodate a variety of sheet formats such that the inflowing sheets may be well supported by a large number of sheet guide bands.

It is another object of the present invention to provide a sheet stacking device such that format adjustment will be done automatically by control of a microprocessor.

The above objects are realized in the present invention by providing a sheet stacking device with a relatively dense arrangement of guide bands, for example separated by a gap of only 75 mm., which may be shifted individually in a lateral direction through a limited interval. This limited lateral movement of the guide bands is enough to allow for the insertion of boundary plates and guide skids between the guide bands such that they may be positioned anywhere along the total width of the stacking area.

BRIEF DESCRIPTION OF THE DRAWINGS

These and other objects of the present invention will become apparent from the detailed description below when taken in conjunction with the following drawings in which.

While the invention will be described in connection with certain preferred embodiments, it will be understood that it is not necessarily intended to limit the invention to those particular embodiments. On the contrary, it is intended to cover all alternatives, modifications and equivalents as may be included in the spirit and scope of the invention as defined by the appended claims.

DETAILED DESCRIPTION OF THE PREFERRED EMBODIMENT

Figure 1:
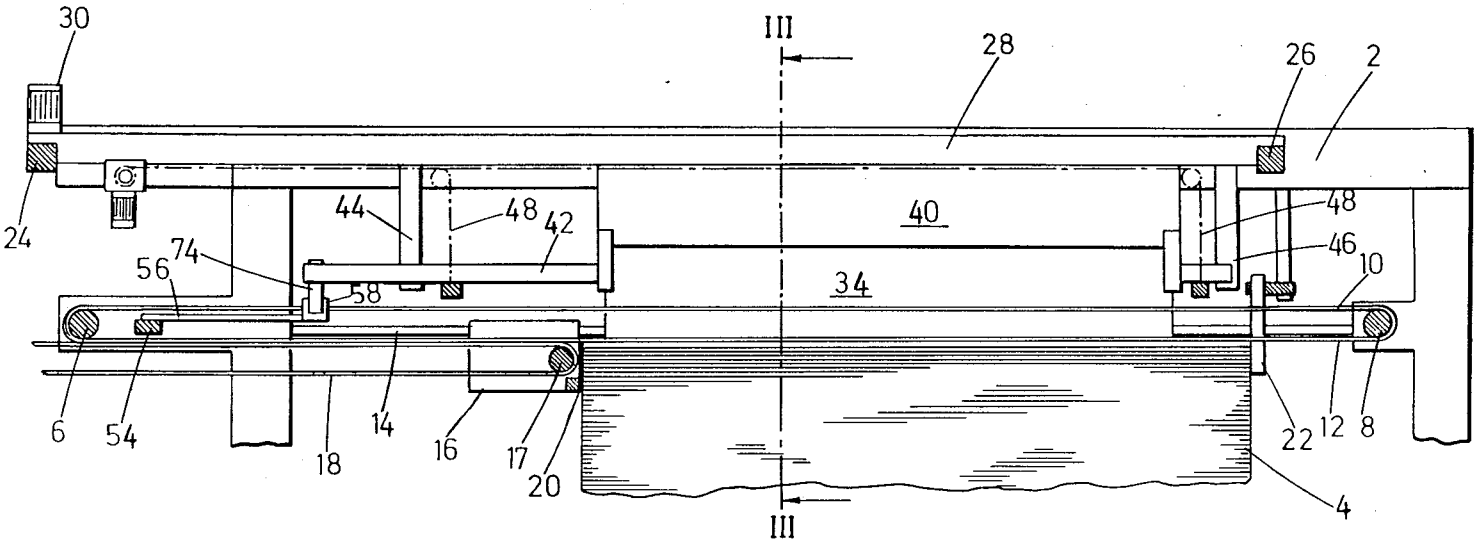
FIG. 1 is a sectional schematic side view of the upper part of a sheet stacking device in accordance with the present invention.
Figure 2:
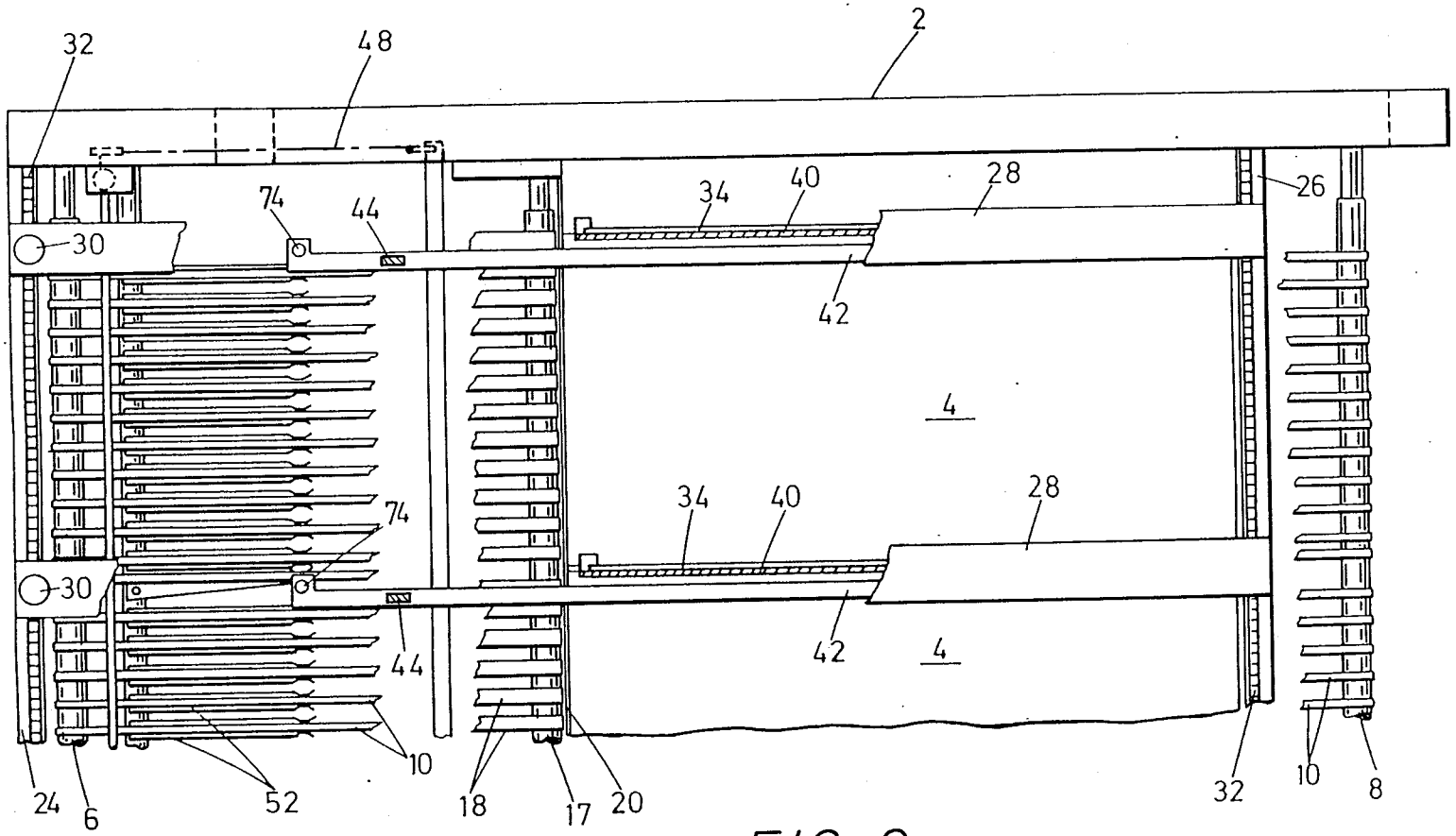
FIG. 2 is a schematic top view of the same device, in which parts appear broken away.

Turning now to the drawings, FIG. 1 shows the upper part of the sheet stacking device of the present invention comprising a frame 2 which supports a stack 4 on a lift table (not shown) which is automatically lowerable in correspondence with the growth of the rising stack 4. In this manner, the upper end of the stack 4 always remains at approximately the same height. Conducted over two transversely mounted smooth-walled rollers 6 and 8, which are positioned in front of and behind the stack 4, respectively, are a large number of endless sheet guide bands 10. Driven by the front roller 6, the guide bands 10 are positioned with generally equal and relatively small spacings, for example separated by a gap of 75 mm., such that the lower stringer 12 runs close above the top of the stack 4. Along both sides of the stack 4 run guide rods 14, to which slidably mounted blocks 16 are attached. The blocks 16 are adjustable according to format length and serve as carriers for a roller 17, about which adjacently lying sheet feed bands 18 defining a face-side sheet feeder are conducted, as well as serving as a contact plate 20 lying adjacent to the rear end of the stack. Opposite the contact plate 20, at the front end of the stack is a horizontally fixed stop plate 22 which may be raised in the frame 2, upon which incoming sheets will impinge.

Figure 3:
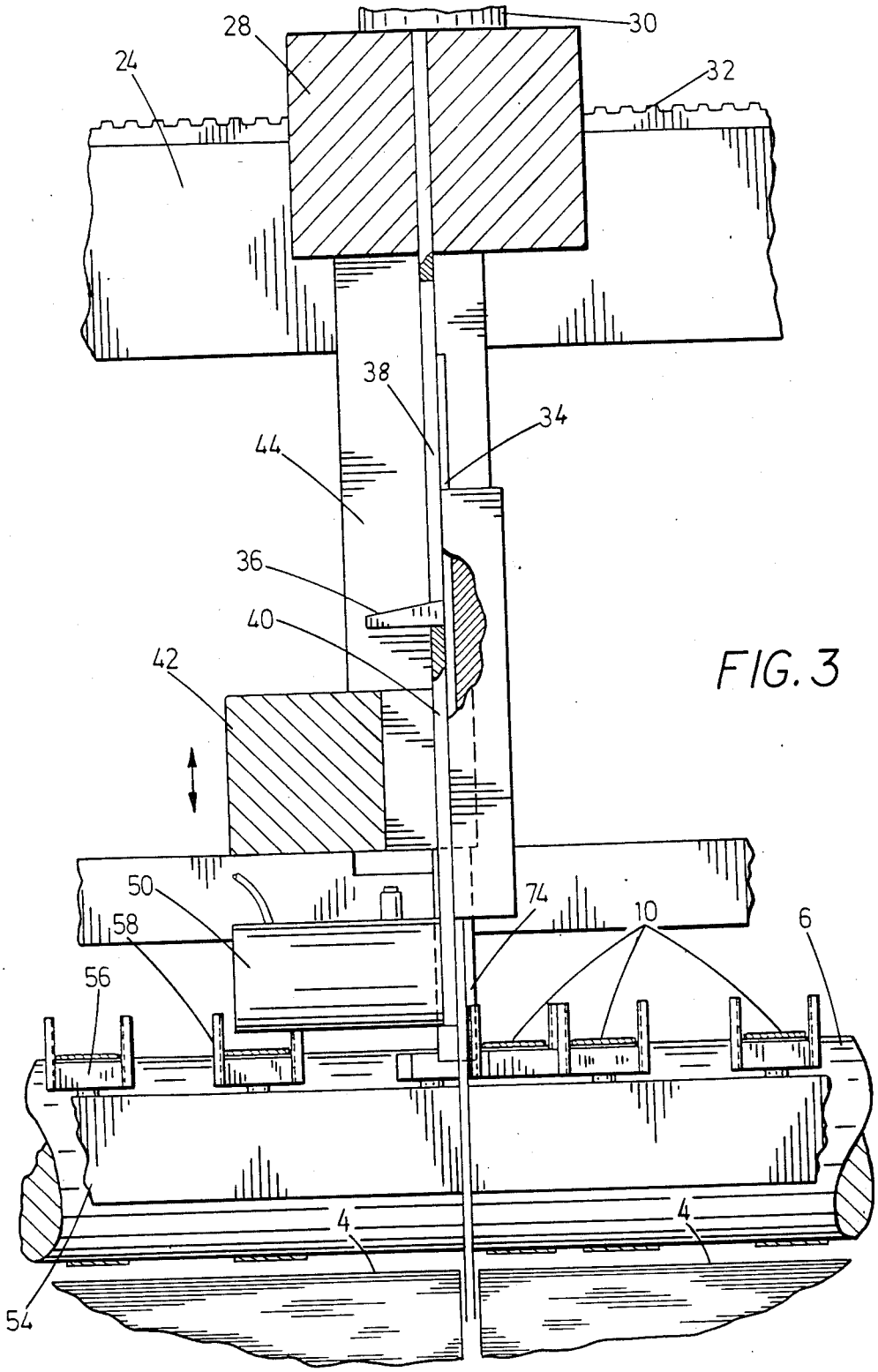
FIG. 3 is an enlarged sectional view of one of the lateral boundary plates and its suspension means and the sheet guide bands, corresponding to the section line III—III of FIG. 1.

The present invention includes in the frame 2 two transversely running rails 24 and 26 on which there are mounted several traversers 28 which may be driven in a lateral direction by means of motor drives 30 in connection with gear racks 32. Each traverser 28 carries a lateral boundary plate 34 for the stack 4. As can be seen in FIG. 3, the boundary plates 34 are slidably mounted to the traversers 28 so as to allow up and down movement of the plates 34 in relation to the stack. Projecting perpendicular to the plane of the boundary plate 34 is a lateral arm 36, which extends through a corresponding slit 38 of the guide plate 40 which is firmly joined with the traverser 28. On one side of the guide plate 40 there is a spar 42 running parallel to the traverser 28, and is mounted for upward-downward movement in two rails 44 and 46 extending downward from the traverser. The spar may be lifted by means of a motor driving a chain 48, while its downward movement occurs under its own weight. On the spar 42 rests the lateral arm 36 of the plate 34, whereby the boundary plate 34 may be raised with the spar 42. The arms 36 acting in conjunction with the slits 38 will limit the downward stroke of the boundary plates 34. The boundary plates 34 are placed such that in their lowered position, like the plates 20 and 22, they enclose between them the upper section of the stack 4, where the sheets which have been fed in have not yet come to a final rest. A vibrator 50 mounted to the guide plate 40 underneath the spar 42 communicates to the boundary plate 34 a shaking movement which is directed substantially perpendicular to the main plane of the boundary plate 34, and whereby the side surfaces of the stack are knocked into alignment.

Alternatively, instead of plates 34 being moved up and down with respect to their corresponding traversers 28, the same effect may be achieved through the up and down movement of a frame to which the traversers themselves may be mounted.

Figure 4:
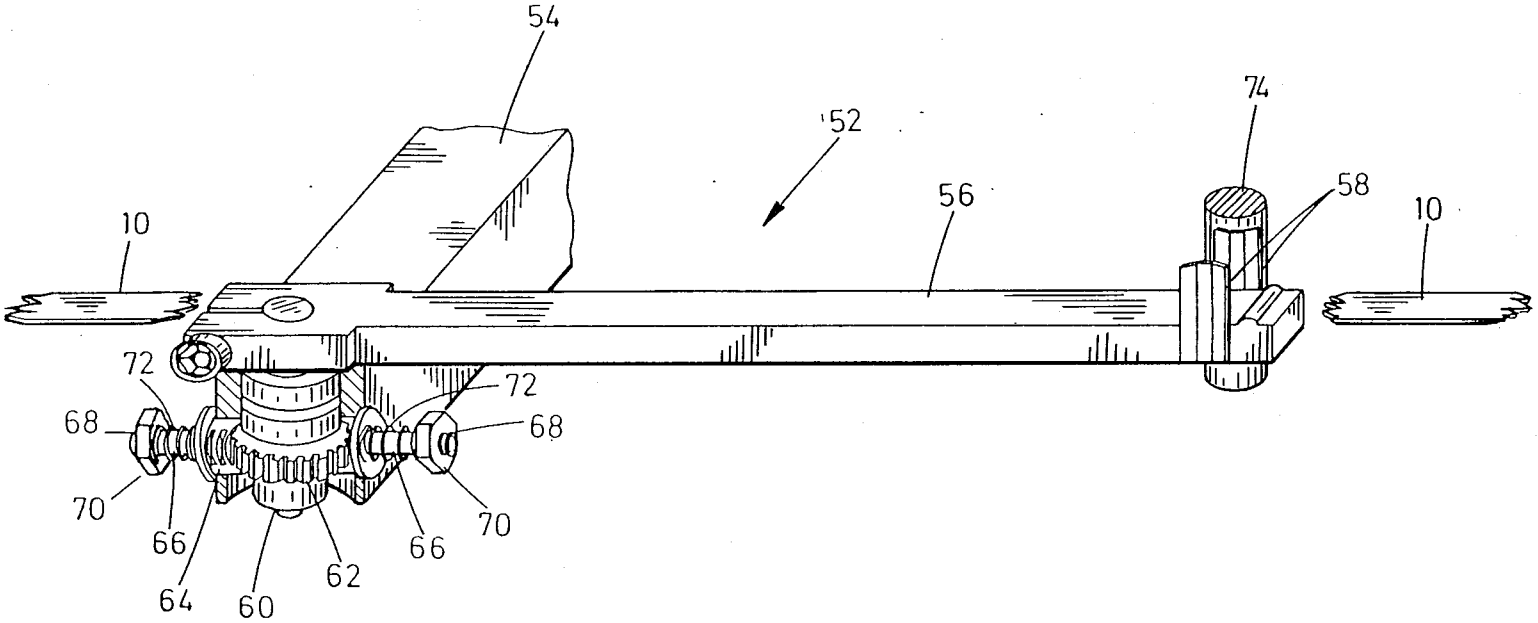
FIG. 4 is a perspective view depicting the band guide means of a single sheet guide band and restoring spring means acting on it.

As in FIG. 4, the sheet guide bands 10 which are run over smooth rollers 6 and 8 are independently laterally guided by guide means 52. The band guide means consists of adjacently lying fork-type arms 56 movable about a vertical axis, which are mounted to a transversely running spar 54 of the frame 2, and are present for each individual guide band 10. At its outward end each arm 56 carries guide pieces 58 on both sides in the form of prongs, between which the guide band is run. Present on the bodily axis 60 to which the arm is firmly clamped, is a toothed rim 62 which meshes with a gear rack 64 which is longitudinally slidable in the spar 54. The gear rack 64 has continuations 66 on both sides projecting past the spar 54, which carry on their ends threads 68 to which nuts 70 are applied. Between the spar 54 and nut 70, the continuations 66 are surrounded by spiral pressure springs 72 which tend in common to hold the gear rack 64 and corresponding arm 56 in its middle position, such that the arm 56 extends perpendicularly with respect to the spar 54.

From each of the spars 42 in the zone of the guide pieces 58 there extends downward a stop pin 74, with which the particular spar may apply lateral movement to the arm. In this action, the arm together with the guide band 10 guided by the guide pieces 58 is deflected laterally against the restoring force of the springs 72.

Figure 5:
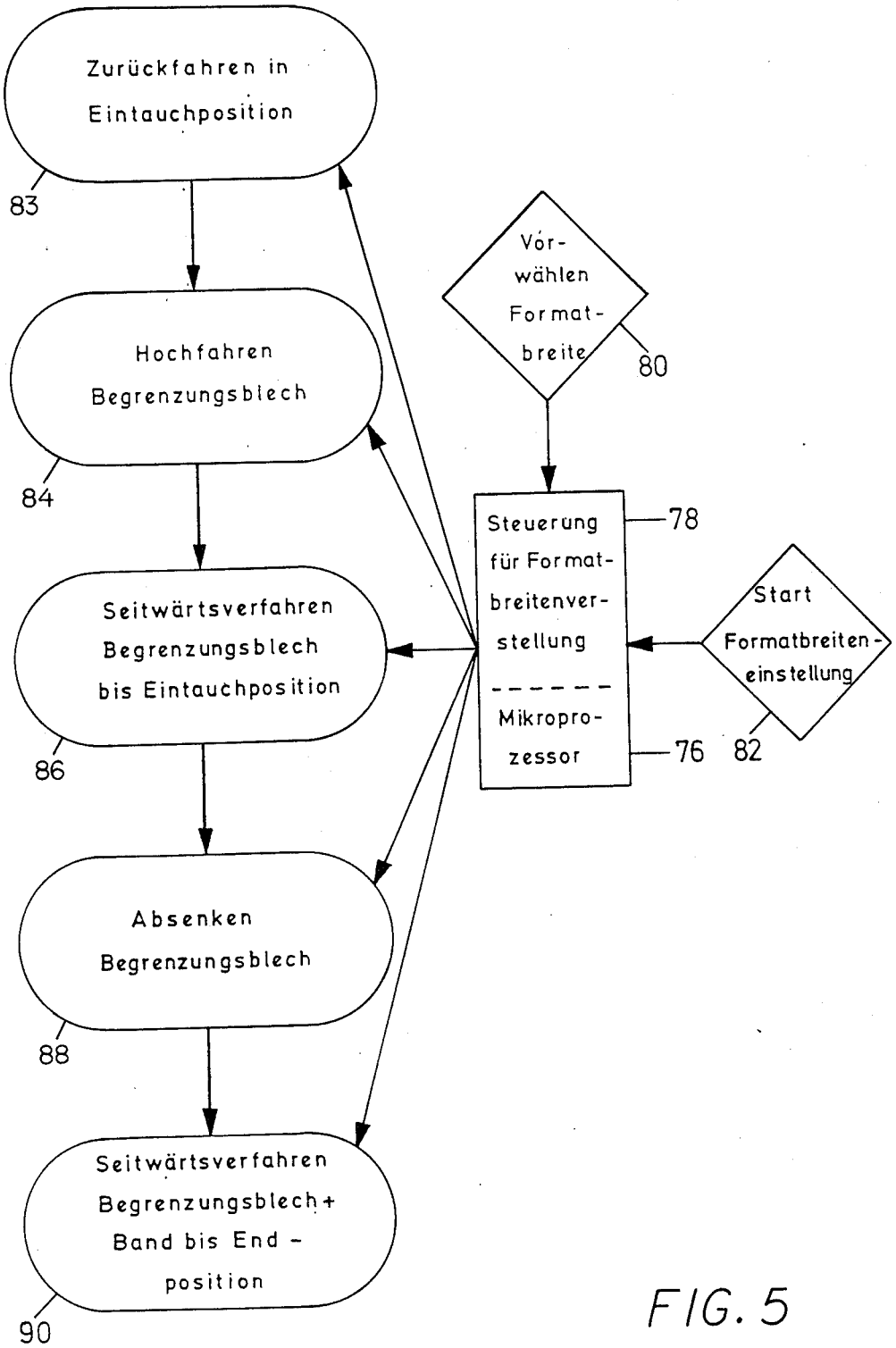
FIG. 5 is a flow diagram showing the various steps involved in the automatic format adjustment process on a sheet stacking device in accordance with the present invention.

Thus it is seen from the above description that the sheet stacking device of the present invention is automatically adjustable for any format width. Turning now to FIG. 5, the control means for these adjustments is provided by a format width adjustment controller 78 containing a microprocessor 76, which uses a preselected format width to move one or more of the traversers 28 with raised spar 42 and boundary plate 34 laterally to the desired position. If during this adjustment process the microprocessor 76 determines by a comparison with stored values, that the desired position is one in which the plate 34, if lowered, would strike one of the bands 10, then the microprocessor 76 advances the traverser to a position where the plate is able to plunge between bands, i.e. a "plunge-in" position, and will be adjacent to the band of concern, then lowers the plate 34 and spar 42 downward. In the process, the stop pin 74 present on the spar enters between the relevant arms 56. The microprocessor 76 then continues the lateral movement of the traverser 28 to its desired end position, such that the stop pin 74 strikes against the guide piece 58 standing in the way, and results in the lateral movement of the associated arm 56. Along with the arm 56, the associated band 10 is laterally deflected, while all the other bands remain in their original position.

Turning now to FIG. 5, this adjustment process is shown with the aid of a flow diagram. Along with the flow diagram is shown the format width adjustment controller 78 containing a microprocessor 76, which serves as a control means for the various steps involved in the adjustment process. At the beginning of the process, the desired format width is entered in step 80, a step which is typically done manually. Next, in step 81 a start key is operated to begin the desired adjustment. In step 82 the microprocessor 76 determines if the stop pin 74 present on the spar 54 is currently deflecting a guide arm 56. If a guide arm is being deflected, then the process goes to step 83 where the traverser and boundary plate are moved to the previous "plunge-in" position between the bands 10, then step.84 is entered; otherwise the process continues directly to step 84 from step 82. In step 84 the spars and the affected boundary plates are driven to their upper position. Next, in step 86 the traverser 28 and spars with raised boundary plates are driven laterally to the new "plunge-in" position. Then in step 88 the spars 42 are lowered, likewise lowering the boundary plates 34 between two adjacently lying bands 10. In step 89 it is determined if the new "plunge-in" position is the same as the desired end position. If the new "plunge-in" position is not the same as the desired end position, then in step 90 the traverser 28 is driven laterally to the final, desired end position. The format adjustment process is then complete as shown in step 91.

It is apparent from the description above, the system of the present invention provides a sheet stacking device with which it is possible to arrange a large number of sheet guide bands positioned relatively close together, where these guide bands may be deflected laterally so as not to interfere with the setting of the lateral boundary plates during a format width adjustment. Furthermore, such format width adjustments may be done fully automatically.

It is obvious that in the case of the formation of only one stack 4, one of the two boundary plates 34 and associated traverser 28 may remain stationary, while the other should be adjusted to accommodate the particular format width. On the other hand, it is common to simultaneously form several adjacently lying stacks, wherein several boundary plates 34 are moved laterally and adjusted to accommodate for the particular format widths.

While ordinarily all unused lateral boundary plates 34 and their associated traversers 28 are removed from the apparatus, it is possible with the present invention to leave them attached to the apparatus and move them out of the way to a parked position. This process may also be controlled automatically by the microprocessor 76. Furthermore, the microprocessor 76 can also be used to control the driving of the blocks 16 carrying the roller 17 and the contact plate 20, along the guide rods 14 to a position which will accommodate the particular format length involved.

What is claimed is:

1. A sheet stacking device which may be adjusted to accommodate sheets of different format widths, comprising a lift table automatically lowerable in correspondence to the height of a forming stack, a face-side sheet feeder having a plurality of feed sheet bands, a plurality of driven endless sheet guide bands extending longitudinally beyond the ends of said stack of which at least individual ones are laterally movable, at least one stop plate positioned opposite said sheet feeder, and several longitudinally running boundary plates, wherein said boundary plates are at least partially laterally shiftable and are fully raisable and lowerable, wherein said guide bands are normally arranged in equal intervals over the entire width of said stack, wherein at least individual ones of said boundary plates are raisable over said guide bands and laterally movable independently of said guide bands, wherein said boundary plates may be moved laterally to a predetermined end position, and wherein said selective guide bands precluding movement of said boundary plates toward a predetermined end position are laterally movable through a limited interval.

2. A sheet stacking device according to claim 1, wherein said guide bands standing in the way of said boundary plates during lateral movement toward a predetermined end position may be moved along laterally with the corresponding boundary plates.

3. A sheet stacking device according to claim 2, further comprising drive and control means for automatic raising and lowering of said boundary plates, and drive and control means for automatic lateral moving of said boundary plates in dependence upon a presettable format width.

4. A sheet stacking device according to claim 3, wherein said drive and control means for automatic lateral moving of said boundary plates contains a microprocessor which acts in dependence upon a predetermined format width to determine a gap between particular sheet guide bands which lie closest to said end position of said boundary plates, and which may discontinue the lateral movement of said boundary plates at said gap and trigger a lowering movement in order to bring about another lateral movement of said boundary plates together with any guide bands standing in the way of the lateral movement of said boundary plates to said end position.

5. A sheet stacking device according to claim 1, further comprising drive and control means for automatic raising and lowering of said boundary plates, and drive and control means for automatic lateral moving of said boundary plates in dependence upon a presettable format width.

6. A sheet stacking device according to claim 1, further comprising guide means for individual said guide bands, wherein said guide means is subject to the action of an elastic restoring force which tends to hold the associated band in a position with equal distances to adjacent bands.

7. A sheet stacking device according to claim 6, wherein said guide bands are run over smooth cylinder rollers and said guide means presents forks enclosing the associated bands between prongs of said fork.

8. A sheet stacking device according to claim 7, wherein said boundary plates are adapted to adjust said guide means.

9. A sheet stacking device according to claim 8, wherein said boundary plates, in conjunction with a stop coupled therewith, adjust said guide means.

10. A sheet stacking device according to claim 1, wherein said boundary plates not needed at the moment are movable into a parked position.

11. A sheet stacking device according to claim 1, wherein said boundary plates are individually suspended on laterally drivable traversers, said traversers being vertically movable.

12. A sheet stacking device according to claim 11, wherein said traversers are mounted on a frame which is movable up and down.

13. A sheet stacking device according to claim 11, wherein at least one shaking device is operatively coupled with said boundary plates.

14. A sheet stacking device according to claim 1, wherein said sheet guide bands not interacting with said boundary plates will be separated by a gap of between 60 and 100 mm.

15. A sheet stacking device according to claim 14, wherein said gap is about 75 mm.

* * * * *